US008757487B2

(12) United States Patent
Santini et al.

(10) Patent No.: US 8,757,487 B2
(45) Date of Patent: Jun. 24, 2014

(54) OPTOELECTRONIC DIGITAL APPARATUS FOR ASSISTING AN OPERATOR IN DETERMINING THE SHOOTING ATTITUDE TO BE GIVEN TO A HAND-HELD GRENADE LAUNCHER SO AS TO STRIKE A MOVING TARGET, AND RESPECTIVE OPERATION METHOD

(75) Inventors: Nicola Santini, Quarrata (IT); Andrea Magi, Figline Valdarno (IT); Enrico Fossati, Rignano S. Arno (IT)

(73) Assignee: Selex Galileo S.p.A., Campi Bisenzio (IT)

( * ) Notice: Subject to any disclaimer, the term of this patent is extended or adjusted under 35 U.S.C. 154(b) by 2 days.

(21) Appl. No.: 13/810,160

(22) PCT Filed: Jul. 12, 2011

(86) PCT No.: PCT/IB2011/001620

§ 371 (c)(1),
(2), (4) Date: Mar. 27, 2013

(87) PCT Pub. No.: WO2012/007820

PCT Pub. Date: Jan. 19, 2012

(65) Prior Publication Data

US 2013/0181047 A1 Jul. 18, 2013

(30) Foreign Application Priority Data

Jul. 12, 2010 (IT) ..... TV2010A0100

(51) Int. Cl.

| | |
|---|---|
| ***G06F 19/00*** | (2011.01) |
| ***G06G 7/80*** | (2006.01) |
| ***F41G 1/48*** | (2006.01) |
| ***F41G 3/16*** | (2006.01) |
| ***F41G 3/06*** | (2006.01) |

(52) U.S. Cl.

CPC .. *F41G 1/48* (2013.01); *F41G 3/16* (2013.01); *F41G 3/473* (2013.01); *F41G 3/06* (2013.01)

USPC ..... 235/404; 235/414; 89/41.18

(58) Field of Classification Search

USPC ..... 235/404, 414, 411, 412, 416, 417; 89/41.18

See application file for complete search history.

(56) References Cited

U.S. PATENT DOCUMENTS

| | | | | |
|---|---|---|---|---|
| 2011/0101097 | A1* | 5/2011 | Olden et al. | 235/404 |
| 2012/0138681 | A1* | 6/2012 | Schneider et al. | 235/404 |
| 2012/0223139 | A1* | 9/2012 | Talir et al. | 235/404 |

FOREIGN PATENT DOCUMENTS

DE 3837922 5/1990

(Continued)

OTHER PUBLICATIONS

International Search Report for International Patent Application Serial No. PCT/IB2011/001620; Search Report Completed: Nov. 30, 2011, 3 pages.

(Continued)

*Primary Examiner* — Edwyn Labaze

(74) *Attorney, Agent, or Firm* — Bryan A. Santarelli; Graybeal Jackson LLP

(57) ABSTRACT

An embodiment of an optoelectronic apparatus for assisting an operator in determining the shooting attitude to give to a hand-held grenade launcher so as to strike a moving target including an electronic processing unit configured so as to: measure the pitch angle and the heading angle of the grenade launcher and the distance of the target when the grenade launcher is moved by the operator during the pointing of the moving target, determine position data indicative of the positions of the moving target, determine a future impact time of the grenade on the target on the basis of position data and of data indicative of the ballistics of the grenade, determine a shooting attitude of the target on the basis of the impact time, measure the pitch angle and heading angle indicating the attitude imparted to the grenade launcher by the operator, compute a pitch difference between the shooting pitch angle and the pitch angle measured and a heading difference between the shooting heading angle and the heading angle measured, communicate to the operator the variation of pitch and/or heading to be given to the grenade launcher so that the pitch and/or heading difference is zero.

15 Claims, 7 Drawing Sheets

(56) References Cited

FOREIGN PATENT DOCUMENTS

| | | |
|---|---|---|
| EP | 0785406 | 7/1997 |
| FR | 2344807 | 10/1977 |
| FR | 2459443 | 1/1981 |
| IT | TV2010A000060 | 4/2010 |
| WO | 9601404 | 1/1996 |
| WO | 2011128762 | 10/2011 |

OTHER PUBLICATIONS

International Preliminary Report on Patentability for International Application Serial No. PCT/IB2011/001620; Search Report Completed: Aug. 3, 2012, 31 pages.

* cited by examiner

OPTOELECTRONIC DIGITAL APPARATUS FOR ASSISTING AN OPERATOR IN DETERMINING THE SHOOTING ATTITUDE TO BE GIVEN TO A HAND-HELD GRENADE LAUNCHER SO AS TO STRIKE A MOVING TARGET, AND RESPECTIVE OPERATION METHOD

PRIORITY CLAIM

The present application is a national phase application filed pursuant to 35 USC §371 of International Patent Application Serial No. PCT/IB2011/001620, filed Jul. 12, 2011; which further claims the benefit of Italian Patent Application Serial No. TV2010A000100 filed Jul. 12, 2010; all of the foregoing applications are incorporated herein by reference in their entireties.

TECHNICAL FIELD

An embodiment relates to an optoelectronic digital apparatus for assisting an operator in determining the shooting attitude to be given to a hand-held grenade launcher so as to strike a moving target and to a respective operation method.

BACKGROUND

The changing scenario of use of the armed forces have recently imposed a comprehensive reconsideration of the tasks and equipment to be allocated to military operators in the operations settings and in particular the more widespread and effective use of high-caliber ammunition so as to allow high precision during combat and consequentially a high capacity of reducing enemy capability.

For this purpose, it became necessary to equip the military operator with a weapon system that includes not only a traditional hand-held weapon such as a rifle, but also a grenade launcher, which is coupled to the hand-held weapon to enable the operator to launch towards a moving target high-caliber ammunition, greater than or equal to approximately 40 mm, which as known, is indicated by the word "grenade".

However, the use of weapon systems integrating a grenade launcher of the above-described type has had, to date, a relatively limited distribution because the probability of failure of striking a moving target by a single grenade was found to be quite high, and, therefore, not acceptable in war scenarios.

In fact, the probability of failure in hitting a moving target with a grenade launched from a weapon system of the type described above crucially depends on determining the correct shooting attitude to be given to a grenade launcher by the operator. Such an assessment has proven, however, to be extremely complex and, therefore, susceptible to errors as the operator must make, extremely quickly, especially in combat scenarios, a visual estimate of the distance from the moving target, a visual estimate of the angle of the site where the moving target is, and a determination of the shooting attitude to be given to the grenade launcher taking into account the movement of the target, the distance, the angle, and the trajectory of the grenade, which trajectory, as known, may prove to be particularly difficult to determine.

EP 0785 406 A2, which is incorporated by reference, relates to an improved method and device for aiming and firing a rifle-mounted grenade launcher without having to approximate the range of a target and then manually adjust the position of subsequently fired grenades. The grenadier initiates the process by pointing the grenade launcher at the stationary target. The range and azimuth of the stationary target are determined by a microprocessor-controlled laser range-finder/digital compass combination. A ballistic solution is calculated by the microprocessor and the superelevation required to place the grenade on a stationary target is displayed on one of several video displays.

Therefore, the use of weapon systems provided with hand-held grenade launchers of the above-described type has proven to be very inconvenient to date, as it involves a high localization risk of the military operator along with a low probability of striking a target with grenades.

SUMMARY

An embodiment is an optoelectronic digital apparatus adapted for assisting an operator both in determining the shooting attitude to be given to the hand-held grenade launcher and in the spatial orientation to be given, moment by moment, to the grenade launcher according to the given shooting attitude responding to the guidance of the grenade launcher by the operator itself, so as to increase the probability of success of striking a moving target with a grenade.

According to an embodiment an optoelectronic digital apparatus is provided for assisting an operator in determining the shooting attitude to be given to a hand-held grenade launcher so as to strike a moving target with a grenade.

According to an embodiment a method for assisting an operator is further provided, by way of an optoelectronic digital apparatus, in determining the shooting attitude to be given to a hand-held grenade launcher so as to strike a moving target, by way of a grenade.

According to an embodiment further provided is a computer product loadable onto the memory of an electronic calculator for assisting an operator, when implemented by the electronic computer itself, in determining the shooting attitude to be given to a hand-held grenade launcher so as to strike a moving target.

BRIEF DESCRIPTION OF THE DRAWINGS

One or more non-limitive embodiments will now be described with reference to the annexed drawings, in which.

DETAILED DESCRIPTION

Figure 1:
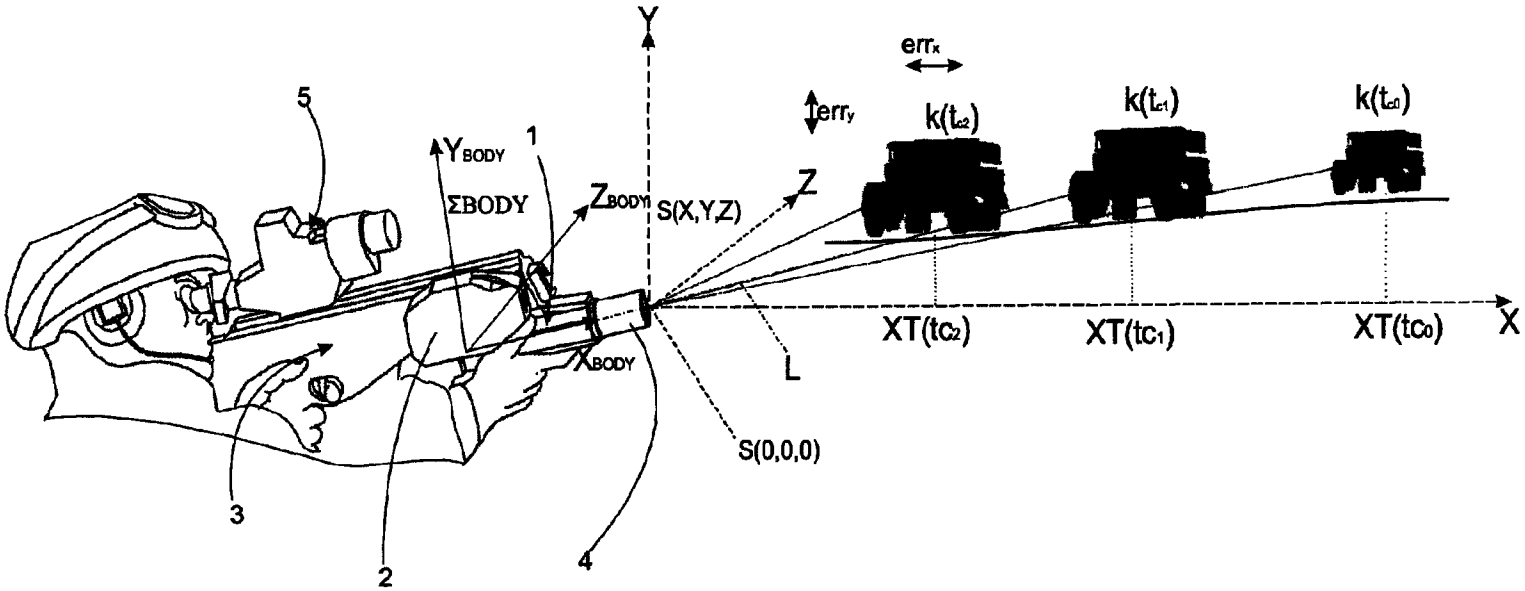
FIG. 1 schematically shows a grenade launcher in a target-pointing attitude provided with an assisting optoelectronic digital apparatus, made according to an embodiment.

With reference to FIG. 1, with number 1 is indicated as a whole a hand-held grenade launcher, to which an assisting optoelectronic apparatus 2 is coupled, the apparatus 2 being configured so as to assist an operator in determining the shooting attitude to be given to the grenade launcher 1 itself so as to strike a moving target k.

The assisting optoelectronic apparatus 2 is also configured so as to communicate to the operator, moment by moment, the angular pitch and heading movements to be given to the grenade launcher 1 to strike the target k, based on the differences in space present between the determined shooting attitude and the instantaneous attitude given to the grenade launcher 1 by the operator and the given next motion of the target k.

The grenade launcher 1 can be preferably, but not necessarily, mounted on a hand-held weapon 3, for example, a rifle and in the example shown in FIG. 1 includes a grenade launch tube 4 presenting a longitudinal axis L coincident and integral with a first Cartesian axis $X_{BODY}$ of a predetermined body reference system ΣBODY associated with the grenade launcher 1, and presenting a second Cartesian axis $Y_{BODY}$, orthogonal to the first Cartesian axis $X_{BODY}$, and a third Cartesian axis $Z_{BODY}$ orthogonal to the first $X_{BODY}$ and to the second Cartesian axis $Y_{BODY}$.

The grenade launcher 1 also includes a pointing device 5 adapted to enable the operator to aim at the moving target k and then place the grenade launcher 1 in a pointing attitude on the basis of the display of the target k itself.

The pointing device 5 is of a known type and, therefore, will not be further described except to clarify that it can be configured so that, for example, in the pointing attitude, the longitudinal axis L of the grenade launch tube 4 intersects the target k.

Figure 2:
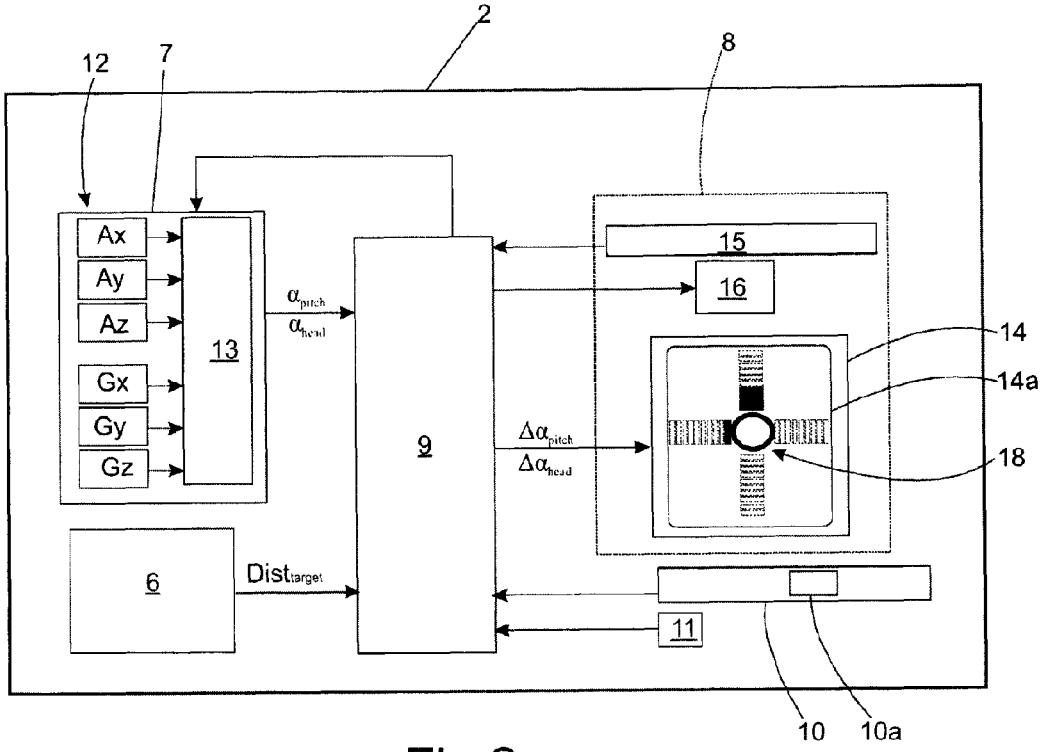
FIG. 2 is a block diagram of the assisting optoelectronic apparatus shown in FIG. 1 according to an embodiment.

With reference to FIG. 2, the assisting optoelectronic apparatus 2 includes an electronic distance measuring device 6, which is configured to measure the distance $Dist_{target}$ of the target k from the grenade launcher 1; and an electronic attitude-measuring device 7, which is configured for determining the instantaneous attitude of the grenade launcher 1, i.e., the pitch angle $\Delta\alpha_{pitch}$ and the heading angle $\Delta\alpha_{head}$ that characterize the attitude itself.

The assisting optoelectronic apparatus 2 also includes a user interface 8 by which an operator is able to issue commands to the assisting optoelectronic apparatus 2, and receives indications on variation in attitude $\Delta\alpha_{pitch}$ and $\Delta\alpha_{head}$ to be given to the grenade launcher 1 to strike the moving target k.

The assisting optoelectronic apparatus 2 also includes an electronic processing unit 9, which is configured so as to compute the pitch angle $\alpha f_{pitch}$, and the heading angle $\alpha f_{head}$ that characterize the shooting attitude, and communicates to the operator, by way of the user interface 8 and, in response to the movement of the grenade launcher 1 itself by the operator, the variation in attitude $\Delta\alpha_{pitch}$, $\Delta\alpha_{head}$ to be given to the grenade launcher 1 to orientate it so as to strike the moving target k.

The assisting optoelectronic apparatus 2 further includes a memory unit 10 containing a series of ammunition-data indicating a plurality of different grenade types employable in the grenade launcher 1.

The memory unit 10 further contains, for each type of grenade, a series of ballistic data associated with the grenade itself, such as: the frontal area S of the grenade, i.e., the area of the front surface of the grenade itself; the mass m of the grenade; the coefficient of aerodynamic resistance Cd of the grenade; the lift coefficient Cl of the grenade; the launching speed of the grenade Vin; and a coefficient Vin1 correlated with the launching speed variation Vin of the grenade at changing temperature T.

The memory unit 10 is also adapted for further storing: environmental data indicating the atmospheric pressure p, the thermodynamic constant of air R; and precision data indicating a minimum desired precision $err_y$ of impact of the grenade on the target k along a vertical axis (e.g., the axis Y in FIG. 1), which is orthogonal to a flat Earth's ground reference surface, and a minimum desired precision $err_x$ of impact of the grenade on the target k along a horizontal axis (e.g. the axis X in FIG. 1) parallel to a flat Earth's ground surface in the shooting direction (errors related to the action range of the grenade in use).

The assisting optoelectronic apparatus 2 also includes sensors 11 adapted to measure the air temperature T, corresponding in the initial step, to the temperature of the grenade.

With reference to FIG. 2, the distance-measuring device 6 may include, for example, a LASER rangefinder (acronym for Light Amplification by Stimulated Emission of Radiation), which is configured so as to emit laser pulses towards the target, and, therefore, determining the distance $Dist_{target}$ of the target from the grenade launcher 1 in function of the "flight time" $t_{flight}$ of the LASER pulse.

Regarding instead the electronic attitude-measuring device 7, in the example shown in FIG. 2 it includes an inertial electronic platform 12 configured to provide in output the acceleration components Ax, Ay, Az and angular velocity components Gx, Gy and Gz of the grenade launcher 1 determined with respect to the body reference system $\Sigma_{BODY}$.

In particular, in the example shown in FIG. 2, the inertial electronic platform 12 conveniently includes one or more accelerometers (not illustrated), for example, a dual-axis accelerometer and two single-axis accelerometers, presenting two measuring axes arranged along the axes $X_{BODY}$ and $Y_{BODY}$ of the body reference system $\Sigma_{BODY}$; and one or more gyroscopes presenting a total of three measuring axes arranged parallel to the axes $X_{BODY}$, $Y_{BODY}$ and $Z_{BODY}$ of the body reference system $\Sigma_{BODY}$.

The attitude-measuring device 7 also includes a computing module 13 receiving the input acceleration components Ax, Ay, Az, and the angular velocity components Gx, Gy and Gz measured by the electronic inertial platform 12, thus processing them to provide in output the pitch angle $\Delta\alpha_{pitch}$, and the heading angle $\Delta\alpha_{head}$.

In this case, the pitch $\Delta\alpha_{pitch}$ and heading $\Delta\alpha_{head}$ angles can be conveniently determined by the computing module 13 by way of, for example, the computing method described in the patent application filed in Italy on Apr. 12, 2010 with the No. TV2010A000060, which is here incorporated by reference.

Regarding the user interface 8, including a screen or display 14 to visualize one or more graphic interfaces, a control device 15, and preferably, but not necessarily, a voice message generating device 16.

In particular, the electronic processing unit 9 can be configured so as to ensure that the display 14 and/or the voice message generating device 16 notifies the operator of attitude variations $\Delta\alpha_{pitch}$ and $\Delta\alpha_{head}$ to be given to the grenade launcher 1, while the control device 15 may include a keyboard provided with a set of keys through which the operator imparts commands to the assisting optoelectronic apparatus 2. In the example shown in FIG. 2, the display 14 is conveniently of an OLED type (acronym for Organic Light Emitting Diode) while the electronic processing unit 9 is configured to ensure that the display 14 also visualizes a supporting graphical interface 14*a* representing the attitude variation $\Delta\alpha_{pitch}$ and $\Delta\alpha_{head}$ to be given to the grenade launcher 1 to strike the moving target k.

In detail, the electronic processing unit 9 is configured to ensure that the assisting graphical interface 14*a* visualized by the display 14 includes a graphical attitude cross 18 provided with a plurality of luminous segments arranged aligned one after the other so as to form a first and a second attitude branch which are mutually orthogonal and intersect a common central point.

More in detail, in the example shown in FIGS. 5-8, the electronic processing unit 9 is configured to switch on/off:

the segments of a vertical attitude branch 20 as a function of the positive or negative variation $\Delta\alpha_{pitch}$ of the pitch angle $\alpha_{pitch}$ to be given to the grenade launcher 1 so as to orient it in the shooting attitude;

the segments of a horizontal attitude branch 21 as a function of positive or negative variation of $\Delta\alpha_{head}$ the heading angle $\alpha_{head}$ to be given to the grenade launcher 1 so as to orient it in the shooting attitude.

More specifically, in the example shown in FIGS. 5-8, the attitude branch 20 is subdivided in correspondence to the midpoint in a first 20*a* and in a second luminous branch 20*b*, wherein the first luminous branch 20*a* includes a predetermined number N1 of segments adapted to be switched on/off in function of the negative variation of the pitch angle $\Delta\alpha_{pitch}$, while the second luminous branch 20*b* includes a predetermined number N1 of segments adapted for being switched on/off in function of the negative variation of the pitch angle $\Delta\alpha_{pitch}$.

The second luminous branch 21 is in turn divided in correspondence to the midpoint in a first 21*a* and in a second luminous branch 21*b*, wherein the first luminous branch 21*a* includes a predetermined number N3 of segments adapted for being switched on/off in function of the negative variation of the heading angle $\Delta\alpha_{head}$, while the second luminous branch 21*b* includes a predetermined number N4 of segments adapted for being switched on/off in function of the positive variation of the heading angle $\Delta\alpha_{head}$.

It should be specified that with the following term "shooting attitude" of the grenade launcher 1 it will be intended the condition in which the grenade launcher 1 is oriented in space ensuring that the grenade will strike the target K; while with the term "pointing attitude" it will be intended the condition in which the operator points at the target by way of the pointing device 5 (FIG. 1).

Figure 3:
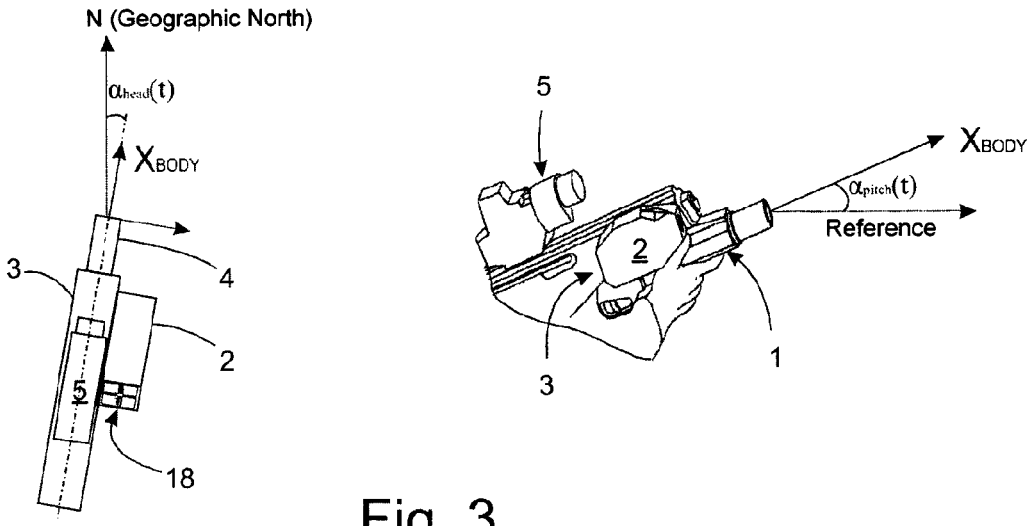
FIG. 3 is a schematic view from above and side elevation of the grenade launcher of FIG. 1 in a shooting attitude according to an embodiment.

More specifically, with reference to FIG. 3, at a generic moment $t_i$, the general attitude of the grenade launcher 1 is characterized by a pitch angle $\alpha_{PITCH}(t_i)$ and a heading angle $\alpha_{HEAD}(t_i)$, wherein the pitch angle $\alpha_{PITCH}(t_i)$ corresponds to the angle present between the first Cartesian axis $X_{BODY}$ and a reference plane lying on Earth's ground level; while the heading angle $\alpha_{HEAD}(t_i)$ corresponds to the azimuth angle present between the first Cartesian axis $Y_{BODY}$ and Earth's geographic NORTH.

As for the voice message generating device 16 it can be configured so as to communicate voice messages containing the attitude variation $\Delta\alpha_{head}$ and $\Delta\alpha_{pitch}$ to be given to the grenade launcher 1 to strike the moving target. The voice-message generating device 16 can include, for example, an electronic digital unit configured to produce digital voice messages and a loudspeaker such as a headset coupled to the electronic digital unit and usable by the operator for listening to information relative to the attitude variation $\Delta\alpha_{head}$ and $\Delta\alpha_{pitch}$ to be given to the grenade launcher 1.

Regarding the electronic processing unit 9, it can include a microprocessor receiving in input: pitch $\Delta\alpha_{pitch}$ and heading $\Delta\alpha_{head}$ angles; the distance $Dist_{target}$ of the target; and commands given by the user by way of the control device 15.

The electronic processing unit 9 also receives a series of data indicative of the type of grenade to be launched such as: the frontal area S, the mass m, the coefficient of aerodynamic resistance Cd; the lift coefficient Cl; the speed of release Vin of the grenade; and the coefficient of variation Vin1.

The electronic processing unit 9 further receives a series of data indicative of the atmospheric pressure p; of the thermodynamic constant of the air R; and data indicative of minimum desired precision impact $err_y$ and $err_x$ along the X and Y axis respectively.

The electronic processing unit 9 is adapted to implement a computing method that, in an embodiment, processes the input variables listed above to communicate to the operator in output, moment by moment, the attitude variation $\Delta\alpha_{pitch}$ and $\Delta\alpha_{head}$ to be given to the grenade launcher 1 for achieving the correct shooting attitude necessary to strike a moving target k.

More specifically, the electronic processing unit 9 is adapted to vary the number N1 and/or N2 of switching on/off of the segments contained in the first luminous branch 20, and the number N3 and/or N4 of switching on/off of the segments contained in the second luminous branch 21, so as to conveniently visually notify the operator the angle to be given so as to place the grenade launcher 1 in the shooting attitude.

With reference to FIGS. 4*a*, 4*b*, 4*c*, and 4*d* it will be described below a computing method implemented by the electronic processing unit 9 to determine the attitude variations $\Delta\alpha_{pitch}$ and $\Delta\alpha_{head}$ to be given to the grenade launcher 1 to strike the moving target k where it is assumed that the assisting optoelectronic apparatus 2 is configured/set on the basis of a particular type of grenade.

In particular, the configuration/setting of the assisting optoelectronic apparatus 2 can provide that: the electronic processing unit 9 notifies the operator by way of the user interface 8 the different types of grenades usable contained in the memory unit 10 and determines in the memory unit 10 itself the data that characterize the grenade ballistics, in response to a selection command of the grenade given by the operator.

Figure 9:
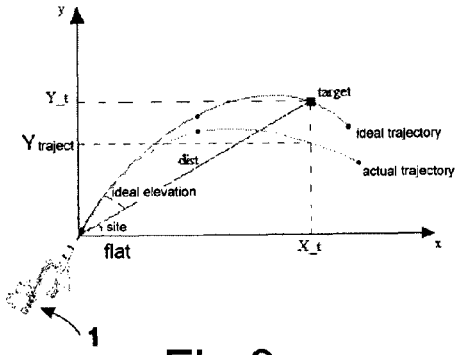
FIGS. 9 and 10 show two examples of the ideal and actual grenade trajectory in a Cartesian plane of reference, when a respectively "flat" and a "non-flat" shot typology is executed, according to an embodiment.
Figure 10:
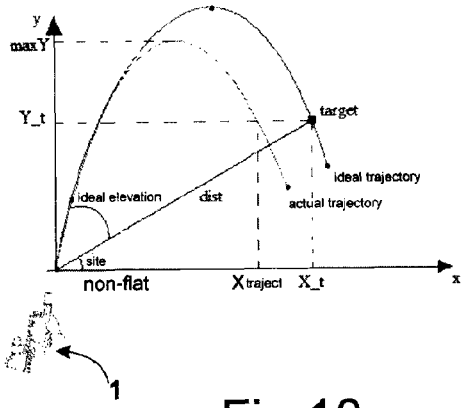

In the initial step, the operator selects, by way of the user interface 8, the type of shooting trajectory to be given to the grenade, which may correspond to a first type, later indicated with "flat shot" an example of which is shown in FIG. 9, or a second type, later indicated with "non-flat shot" an example of which is shown in FIG. 10 (block 100).

The method provides a series of data-acquisition operations, and a series of computing-attitude operations to be given to the grenade launcher 1 to strike the moving target k on the basis of the acquired data.

In particular, the method preferably, but not necessarily, provides that the electronic processing unit 9 communicates to the operator through the user interface 8 a request of pointing/tracking of the target k by way of the grenade launcher for a given time interval.

The operator orients the grenade launcher 1 towards the target k so as to position it in the pointing attitude (block 110) (FIG. 1) and simultaneously imparts by way of the user interface 8 a command to activate data acquisition ($t=t_{c0}$) (block 120). At this step, the assisting optoelectronic apparatus 2 samples at each sampling instant $t_{ci}$ (i comprised between 0 and n): the distances of the target k from the grenade launcher 1 $Dist_{target}=(Dist_{target}(t_{C0}), \ldots, Dist_{target}(t_{Cn}))$, the pitch angles $\alpha_{pitch}=(\alpha_{pitch}(t_{C0}), \ldots, \alpha_{pitch}(t_{Cn}))$ and the heading angles $\alpha_{head}=(\alpha_{head}(t_{c0}), \ldots, \alpha_{head}(t_{Cn}))$ that define the attitude of the grenade launcher 1 (block 130) and stores the sampled data in the memory unit 10 (block 140).

To this aim, the memory unit 10 can be conveniently structured so as to include a circular memory buffer 10*a* (shown in FIG. 1) in which the sampled data $Dist_{target}(t_{ci})$ $\alpha_{pitch}(t_{ci})$, $\alpha_{head}(t_{ci})$ acquired during sampling stored.

The electronic processing unit 9 verifies whether the memory buffer 10 is saturated/full (block 150) and in a negative case (output NO from block 150), increases the sampling moment tci=tci+1 (block 160) and repeats again the steps 130, 140, 150 so as to acquire new data $Dist_{target}(t_{ci})$ $\alpha_{pitch}(t_{ci})$, $\alpha_{head}(t_{ci})$ associated with the movement of the target k.

In a positive case (output YES from block 150), i.e., if the memory buffer 10 is saturated/full, the electronic processing unit 9 temporally sorts the distance/attitude data $Dist_{target}(t_{ci})$, $\alpha_{pitch}(t_{ci})$, $\alpha_{head}(t_{ci})$ contained in the buffer memory 30 (block 170), and processes the same sorted data $Dist_{target}(t_{ci})$, $\alpha_{pitch}(t_{ci})$, $\alpha_{head}(t_{ci})$ to determine the positions PI taken by the target k in time with respect to the Cartesian system S (X,Y,Z) (shown in FIG. 1) whose origin S (0,0,0) is positioned at a predetermined point of the grenade launcher 1, for example at the muzzle of the grenade launch tube 4 (block 180).

In detail, the electronic processing unit 9 computes the target position vectors $PI=Pi(t_{ci})=(XT(t_{ci}), YT(t_{ci}), ZT(t_d)$ starting from the initial sampling moment $t_{ci}=t_{c0\ to}$ to a final sampling moment $t_{ci}=t_{cn}$:

$XT=(Xtarget(t_{c0}), Xtarget(t_d), \ldots, Xtarget(t_{cn}))$ $YT=(Ytarget(t_{c0}), Ytarget(t_d), \ldots, Ytarget(t_{cn}))$ $ZT=(Ztarget(t_{c0}), Ztarget(t_d), \ldots, Ztarget(t_{cn}))$ The electronic processing unit 9 computes on the basis of vectors IP containing the coordinates of the positions taken by the target k in time, and by way of an optimization method, e.g., such as the method of least squares or any other similar motion approximation method of the polynomial functions, preferably, but not necessarily, of first degree, which allow to establish with a certain degree of approximation, the actual positions $Pi(t_{c0})$, $Pi(t_{cn})$ and next positions $Pi(tc_{n+1})$ $P(t_{cn+k})$ taken by the target k during its movement (block 190).

In particular, in this step the method implements the following relations that allow to determine, by way of the polynomial functions F(X), F(y), F(Z) preferably but not necessarily of first degree, the movement of the target in space:

$$F(X)=a_x+b_x*X_i$$

$$F(y)=a_y+b_y*Y_i$$

$$F(Z)=a_z+b_z*Z_i \qquad a)$$

wherein Xi, Yi and Zi are the polynomial variables and $a_i$ is a predetermined value, and $b_i$ is a predetermined angular coefficient.

At this point, the electronic processing unit 9 computes the ideal grenade motion (block 200), implementing an algorithm that determines, starting from an assistance request moment $t_{act}$, the solution to the problem of the ideal grenade motion subject to gravitational force, by way of the determination of range GIT, of the output speed $V_{IN}$ from the grenade launcher 1, the ideal pitch angle $\alpha ideal_{pitch}$ and of the flight time $t_{flight}$ used by the grenade to strike the target k.

It should be made clear that the assistance request moment $t_{act}$ can correspond to the moment when the operator by way of the graphical interface 8 gives a command signal requesting the computation of shooting attitude.

In particular, the electronic processor 1 computes:

$$GIT=\sqrt{X_T^2(t_{act})+Y_T^2(t_{act})+Z_T^2(t_{act})}$$

$$V_{IN}=V_{IN0}+(T-273.15)*V_{IN1}$$

$$\alpha ideal_{pitch}=(1/2)\arcsin(GIT*g/V_{IN}^2)$$

$$t_{flight}=2*(V_{IN}/g)\sin(\alpha ideal_{pitch}) \qquad b)$$

wherein $XT(t_{act})$, $YT(t_{act})$ and $ZT(t_{act})$ are the coordinates of the position PI of the grenade at the assistance request moment $t_{act}$.

The electronic processing unit 9 initializes a counter Inum=0 (block 210) and computes (block 220) the impact moment $t_{imp}$ of the grenade on the target k by way of the following relation:

$$t_{imp}=t_{act}+t_{flight} \qquad c)$$

The electronic processing unit 9 computes by way of the polynomial functions F(X), F(Y), F(Z) the target position $XT(t_{imp})$, $YT(t_{imp})$, $ZT(t_{imp})$ at impact moment $t_{imp}$, and determines the distance $Dist_{target}$ of the target k with respect to the grenade launcher 1 at impact moment $t_{imp}$ itself by way of the following relation:

$$Dist_{target}(t_{imp})=\sqrt{X_T^2(t_{imp})+Y_T^2(t_{imp})+Z_T^2(t_{imp})} \qquad d)$$

The electronic processing unit 9 determines (block 230) a pitch angle $\alpha_{pitch}$ corresponding to the angle to be given to the grenade launcher 1 to strike the target k under ideal conditions, by way of the following relation:

$$\alpha i_{pitch}=\arctan\left(\frac{YT(t_{imp})}{Dist_{target}(t_{imp})}\right) \qquad e)$$

At this point, the electronic processing unit 9 determines whether:

f) the impact distance of $Dist_{target}$ is within a predetermined distance range delimited by a minimum $\alpha_{TMIN}$ and a maximum $\alpha_{TMAX}$ value;

g) the pitch angle $\alpha_{ipitch}$ is within a predetermined angular range delimited by a minimum $\alpha_1$ and a maximum $\alpha_2$ value, in which $\alpha_1$ conveniently has a value of about −0.78 and $\alpha_2$ conveniently is equal to approximately 0.78 (block 240).

In the event in which at least one of the conditions f) and g) is not satisfied (output NO from block 240), the assisting optoelectronic apparatus 2 generates a message that alerts the operator of a condition of non-possibility to compute the shooting angle and requests execution of a new pointing of the target and a new data acquisition (blocks 110-230).

However, if the conditions f) and g) are both satisfied (output YES from block 240), the electronic processing unit 9 initializes an integrating counter i=1 (block 250) to determine the actual trajectory of the grenade on the basis of the ideal trajectory, of the ballistic data, of the environmental data and of the accuracy data.

In particular, the electronic processing unit 9 computes a real infinitesimal displacement $\Delta x_i$ and $\Delta y_i$ of the grenade with respect to the axes X and Y, in a moment of time $t=t_{act}+i*dt$, where dt is a predetermined integrating interval by way of the following relations h) and i) (block 260):

$$\Delta x_i=(x_i-x_{i-1})=V_{in}\cdot\cos(\alpha_{i_{pitch}})\cdot dt-\frac{1}{2}\left(\frac{C_d}{m}\cdot S\cdot\frac{p}{R\cdot T}\right)\cdot\cos(\alpha_{i_{pitch}})\cdot V_{in}^2\cdot dt^2 \qquad h)$$

$$\Delta y_i=(y_i-y_{i-1})=V_{in}\cdot\sin(\alpha_{i_{pitch}})\cdot dt-\frac{1}{2}\left(\frac{C_d}{m}\cdot S\cdot\frac{p}{R\cdot T}\right)\cdot\sin(\alpha_{i_{pitch}})\cdot V_{in}^2\cdot dt^2-g\cdot dt^2 \qquad i)$$

At this point, the electronic processing unit 9 increases the integrating counter i=i+1 and computes the slope of the actual trajectory of the grenade at moment $t_i=t_{act}+i*dt$ by way of the following relation) (block 270):

$$\alpha_{i_{projectile}} = \tan^{-1}\left(\frac{\Delta y_i}{\Delta x_i}\right) \quad \text{l)}$$

The electronic processing unit 9 further computes the speed of the grenade $Vi_{projectile}$ at moment $t_i$ by way of the following relation f) (block 280):

$$V_{i_{projectile}} = \sqrt{\frac{\Delta x_i^2 + \Delta y_i^2}{dt^2}} \quad \text{m)}$$

The electronic processing unit 9 increases again the integrating counter i=i+1 (block 290) and computes the subsequent real infinitesimal displacements Δxi Δyi afflicting the grenade in moments of time $t_i=t_{act}+i*dt$.

In this case, the calculation of each infinitesimal displacement Δxi and Δyi of the grenade along the actual trajectory made in each time interval dt is calculated by way of the following relation n) and o) (block 300):

$$\Delta x_i = (x_i - x_{i-1}) = V_{i_{projectile}} \cdot \cos(\alpha_{i_{projectile}}) \cdot dt - \frac{1}{2}\left(\frac{C_d}{m} \cdot S \cdot \frac{p}{R \cdot T}\right) \cdot \cos(\alpha_{i_{projectile}}) \cdot V_{i_{projectile}}^2 \cdot dt^2 - \frac{1}{2}\left(\frac{C_l}{m} \cdot S \cdot \frac{p}{R \cdot T}\right) \cdot \cos(\alpha_{i_{projectile}}) \cdot \sin(\alpha_{i_{projectile}}) \cdot V_{i_{projectile}}^2 \cdot dt^2 \quad \text{n)}$$

$$\Delta y_i = (y_i - y_{i-1}) = V_{i_{projectile}} \cdot \sin(\alpha_{i_{projectile}}) \cdot dt - \frac{1}{2}\left(\frac{C_d}{m} \cdot S \cdot \frac{p}{R \cdot T}\right) \cdot \sin(\alpha_{i_{projectile}}) \cdot V_{i_{projectile}}^2 \cdot dt^2 + \frac{1}{2}\left(\frac{C_l}{m} \cdot S \cdot \frac{p}{R \cdot T}\right) \cdot \cos(\alpha_{i_{projectile}}) \cdot \cos(\alpha_{i_{projectile}}) \cdot V_{i_{projectile}}^2 \cdot dt^2 - g \cdot dt^2 \quad \text{o)}$$

Figure 4D:
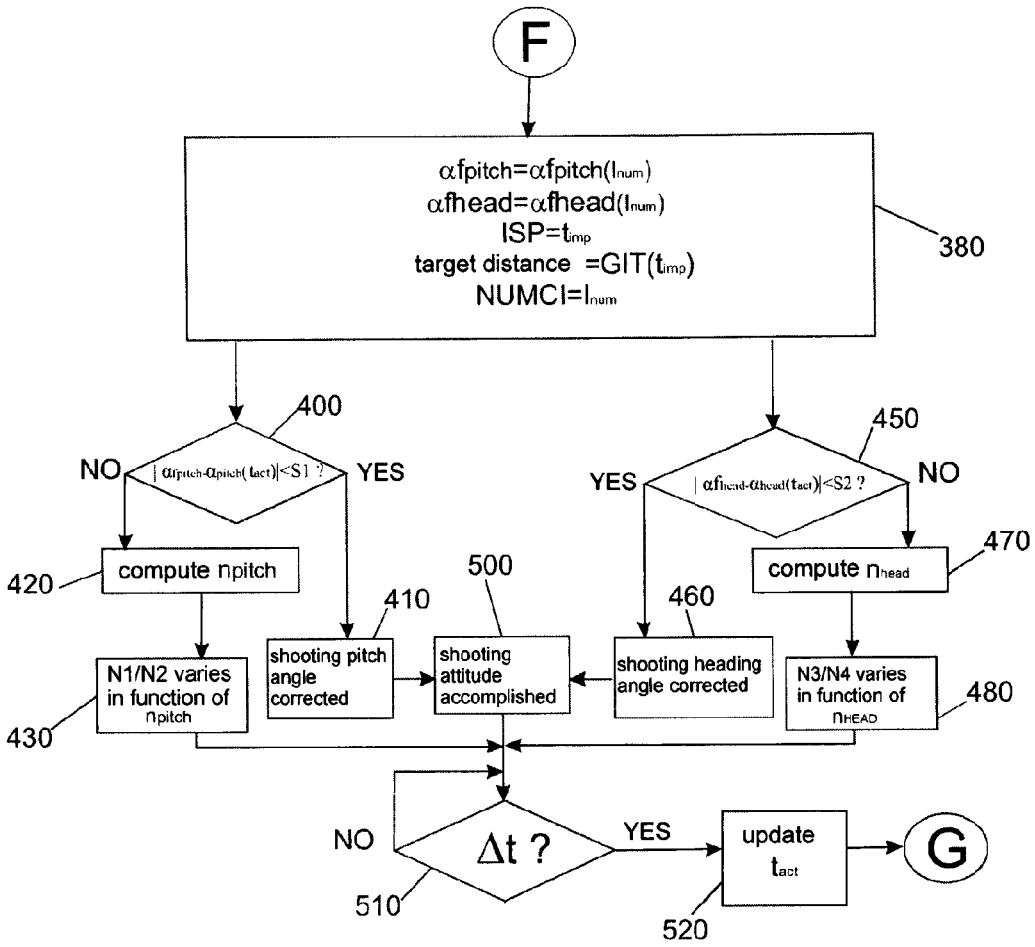
FIGS. 4*a*, 4*b*, 4*c*, and 4*d* show as a whole a flowchart containing the operations implemented by the assisting optoelectronic digital apparatus shown in FIG. 1 according to an embodiment.
Figure 4A:
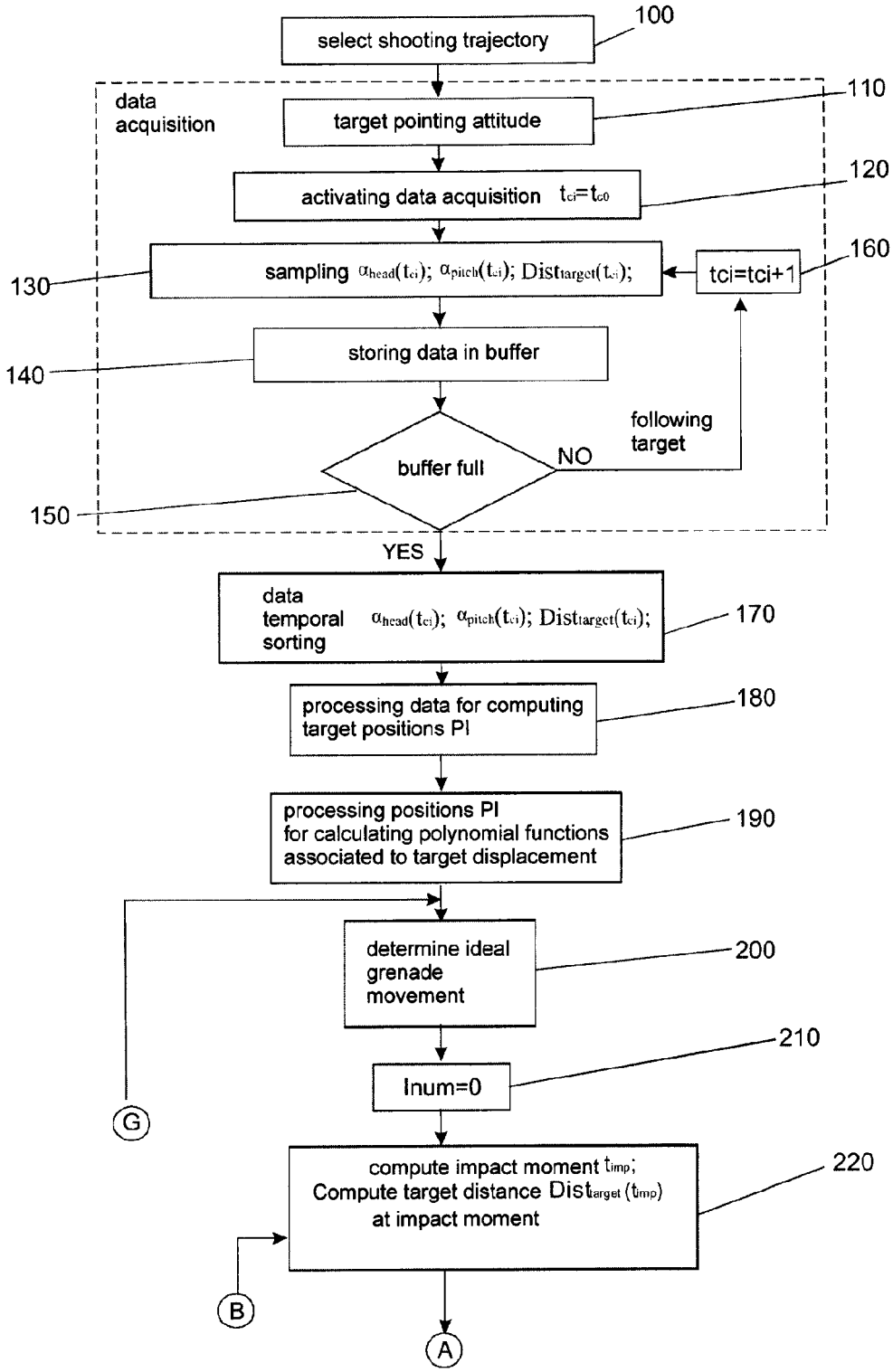
Figure 4B:
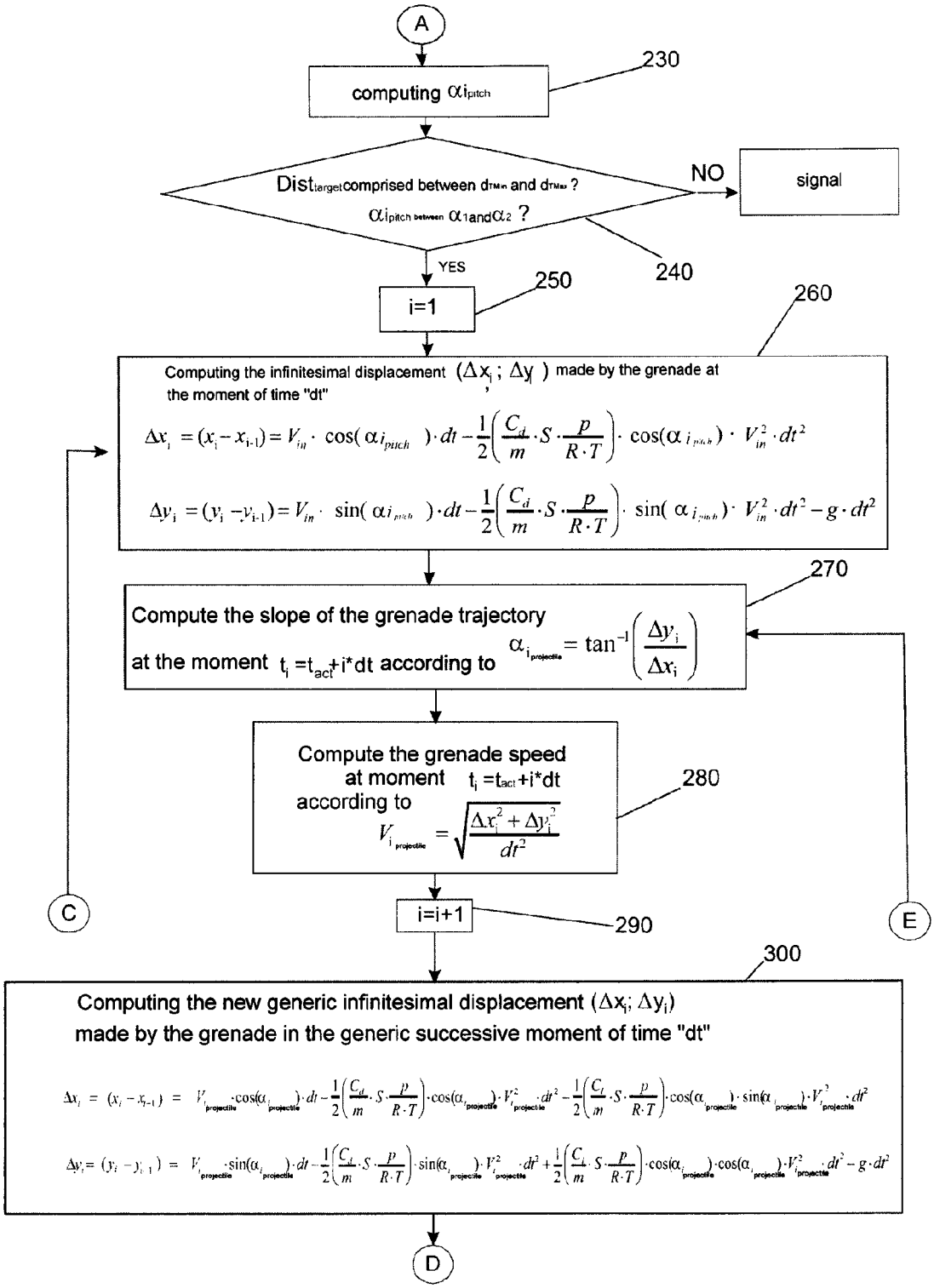
Figure 4C:
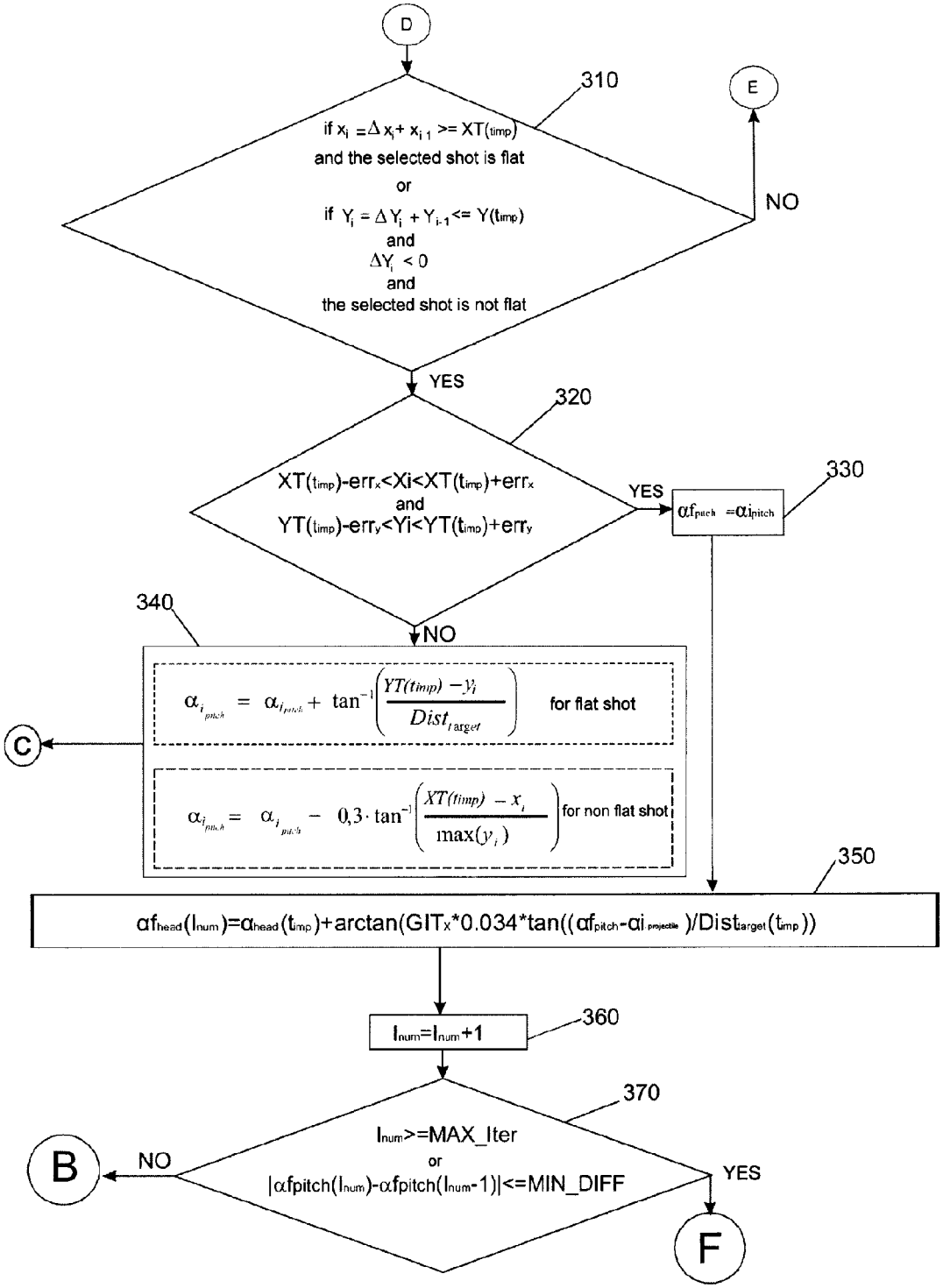

With reference to FIG. 4*c*, following the computation of the infinitesimal displacement, the electronic processing unit 9 determines the new trajectory slope, the new speed of the grenade, and so on until determining the whole actual trajectory corresponding to the ideal start angle αipitch.

In particular, for each integration step of the trajectory, the electronic processing unit 9 verifies whether a first or second condition is satisfied in which:

p) the first condition is satisfied when $X_i=\Delta X_i+X_{i-1}>=XT(t_{imp})$ and the selected shot is flat;

q) the second condition is satisfied when: $Y_i=\Delta Y_i+Y_{i-1}<=YT(t_{imp})$, variation Δyi of the grenade is negative and the selected shot is non-flat (block 310).

If the first p) and the second q) condition are not satisfied (output no from block 310), the electronic processing unit 9 executes again the described steps in blocks 270, 280, 290, 300, 310 so as to continue the process of "integration" of the infinitesimal displacements of the grenade to determine the actual trajectory thereof.

However, if one or both conditions p) or q) are satisfied (output yes from block 310), then the electronic processing unit 9 verifies (block 320) if the third and fourth conditions are satisfied in which:

r) the third condition is satisfied when the displacement $X_i$ of the grenade is in the range delimited by a minimum value $XT(t_{imp})-err_x$ and a maximum value $XT(t_{imp})+err_x$; while s) the fourth condition is satisfied when the displacement $Y_i$ of the grenade is in the range delimited by a minimum value $YT(t_{imp})-err_s$ and a maximum value $YT(t_{imp})+err_y$ (block 320).

If the third r) and fourth s) condition is satisfied (output yes from block 320), the electronic processing unit 9 gives to the pitch shooting angle the value of the pitch angle given from the method in the initial step (i.e. in the block 270) of the computing cycle $\alpha_{ipitch}$:

$\alpha f_{pitch}=\alpha_{ipitch}$ (block 330).

If at least one of r) or s) conditions is not met (output no from block 320) then the electronic processing unit 9 starts computing a new trajectory (block 340), in which the starting angle $\alpha_{pitch}$ varies by way of the relation s) in case of "flat" shot, or by way of the relation t) in case of "non flat" shot:

$$\alpha_{ipitch} = \alpha_{ipitch} + \tan^{-1}\left(\frac{YT(t_{imp}) - y_i}{Dist_{target}(t_{imp})}\right) \quad \text{s)}$$

$$\alpha i_{pitch} = \alpha_{ipitch} - 0,3 \cdot \tan^{-1}\left(\frac{XT(t_{imp}) - x_i}{\max(y_i)}\right) \quad \text{t)}$$

Wherein max(yi) is the maximum value of the trajectory along the Y axis (shown in FIG. 10).

In this case, the electronic processing unit 9 implements again the above described steps provided in the blocks 260-340.

Following the computation of the shooting pitch angle $\alpha f_{pitch}=\alpha_{ipitch}$, the electronic processing unit 9 computes the shooting heading angle $\alpha f_{head}$ by way of the following mathematical relation u):

$$\alpha f_{head}(I_{num}) = \alpha_{head}(t_{imp}) + \text{arctang}\left(GIT_X * 0.034 * \tan\left(\frac{\alpha f_{pitch} - \alpha i_{projectile}}{Dist_{target}(t_{imp})}\right)\right)$$

wherein $GIT_X$ is the projection of the range GIT on the X axis and $\alpha_{head}(t_{imp})$ is the azimuth position of the target k at the impact time $t_{imp}$ of the grenade on the target k itself (block 350).

At this point the electronic processing unit 9 increases the counter $I_{num}=I_{num}+1$ (block 360) and verifies (block 370) if:

u) $I_{num}>=ITMAX$; where ITMAX is a predetermined threshold indicating a maximum number of interactions that can be made during a predetermined computing interval Δt;

$$\alpha f_{pitch}(I_{num})-\alpha f_{pitch}(I_{num-1})|<=\text{MinDiff} \quad \text{v)}$$

wherein MinDiff is a predetermined threshold.

In the event that either condition u) or v) is not satisfied (output no from block 370), the electronic processing unit 9 provides to re-implement the block operations 220-370.

With reference to FIG. 4*d*, whereas if the two conditions u) or v) are satisfied (output yes from block 370), the electronic processing unit 9 confirms the assignment to the shooting pitch angle, and assigns the shooting heading angle $\alpha f_{head}=\alpha f_{head}(I_{num})$, preferably, but not necessarily, to a parameter ISP indicating the moment of explosion of the grenade, the impact moment $t_{imp}$; to the target distance $Dist_{target}$ the value range of the range $GIT(t_{imp})$ and to a counting parameter of the number of cycles NUMCI the counter value $I_{num}$ (block 380).

At moment $t_{act}$, the electronic processing unit 9 determines the effective pitch angle $\alpha_{pitch}(t_{act})$ and verifies if the following first conditional) is satisfied (block 400):

$$|\Delta\alpha_{pitch}(t_{act})|<S1 \quad \text{a1)}$$

where $\Delta\alpha=\alpha_{pitch}-\alpha_{pitch}(t_{act})$ and S1 is a predetermined threshold.

In a positive case, i.e. if the condition a1) is satisfied (output YES from block 400), the electronic processing unit 9 determines that the pitch angle $\alpha_{pitch}(t_{act})$ corresponds to the final pitch angle $\alpha f_{pitch}$, i.e., that the grenade launcher 1 has a correct pitch attitude (block 410) and therefore does not require movements of the grenade launcher 1 adapted to vary the pitch angle $\alpha_{pitch}(t_{act})$ itself.

Figure 8:
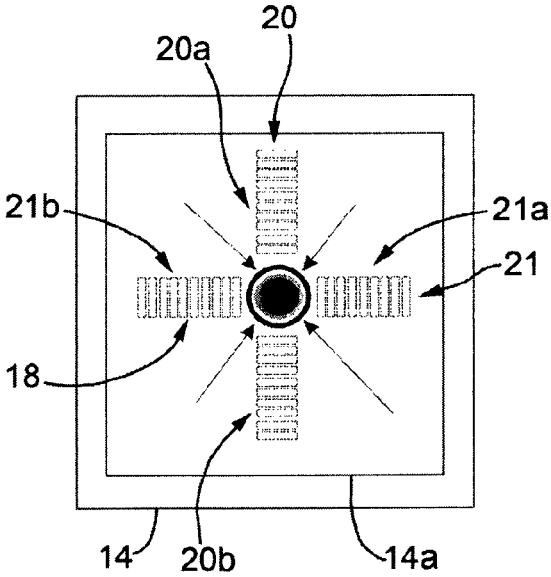

The electronic processing unit 9 commands, by way of the user interface 8, the maintaining of segments N1 and N2 in the off condition so as to communicate to the operator the absence of rotations i.e., variations of the pitch angle to be given to the grenade launcher 1 (block 410) (FIG. 8).

In a negative case (output NO from block 400), i.e., if the conditional) is not satisfied, the electronic processing unit 9 determines the integer to be assigned to the unknown value $n_{pitch}$ to satisfy the condition a2):

$$\Delta\alpha_{pitch}(t_{act})=n_{pitch}*Sa \quad \text{a2)}$$

where Sa is a predetermined angular value associated with each segment of the graphical cross (block 420).

Figure 5:
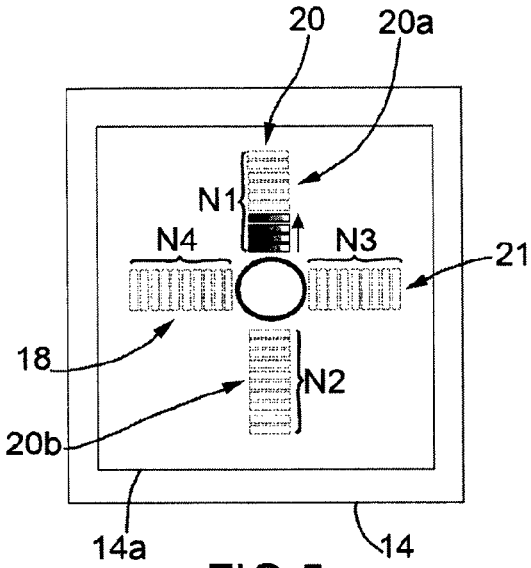
FIGS. 5, 6 7 and 8 schematically show examples of the graphical cross generated by the assisting optoelectronic apparatus to indicate to the military operator the direction to be given to the grenade launcher to strike the moving target according to an embodiment.
Figure 6:
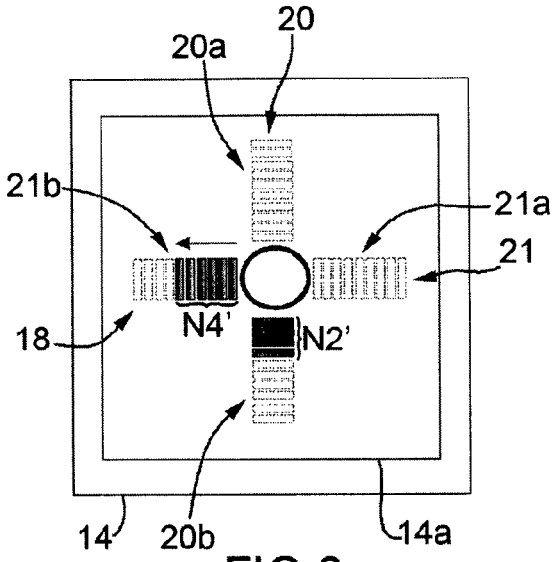
Figure 7:
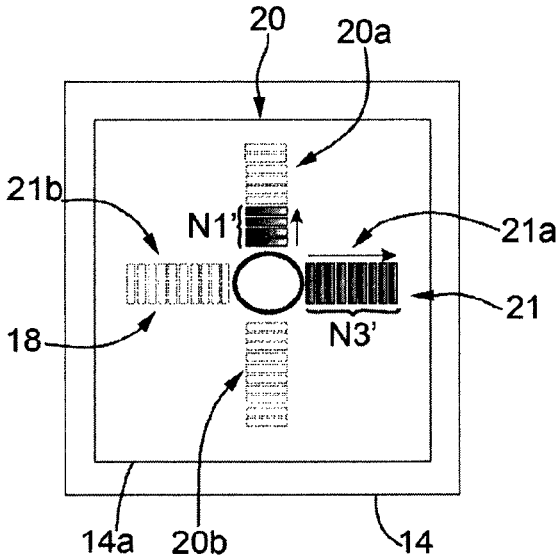

At this point if $n_{pitch}$ has a positive value, the electronic processing unit 9 controls the switching on of a number N1'=$n_{pitch}$ of the luminous segments of the graphical attitude cross 18 by way of the user interface 8 (FIGS. 5,7), while if $n_{pitch}$ has a negative value, the electronic processing unit 9 controls the switching on of a number N2'=$n_{pitch}$ of the luminous segments of the graphical attitude cross 14 by way of the user interface 8 (block 430) (FIG. 6).

At moment $t_{act}$, the electronic processing unit 9 also determines the heading angle $\alpha_{head}(t_{act})$ and verifies if the following condition b1) is satisfied (block 450):

$$|\Delta\alpha_{head}(t_{act})|<S2 \quad \text{b1)}$$

where $\Delta\alpha_{head}(t_{act})=\alpha_{fhead}-\alpha_{head}(t_{act})$ where S2 is a predetermined threshold.

In a positive case (output yes from block 450), i.e., if the condition b1) is satisfied, the electronic processing unit 9 determines that the heading angle $\alpha_{head}(t_{act})$ corresponds to the final heading angle $\alpha f_{head}$, i.e., that the grenade launcher 1 has a correct heading attitude (block 460) and therefore does not require movements of the grenade launcher 1 adapted to vary the heading angle $\alpha_{head}$ itself.

The electronic processing unit 9 commands, through the user interface 8, the maintaining of segments N3 and N4 in a switching off position so as to communicate to the operator the absence of rotations $\alpha_{head}$ to be given to the grenade launcher 1 (FIGS. 5 and 8).

In a negative case, i.e., if the condition b1) is not satisfied, the electronic processing unit 9 determines the integer to be assigned to the unknown value $n_{head}$ to satisfy the following condition b2):

$$\Delta\alpha_{head}=n_{head}*Sa(\text{block } \mathbf{470}) \quad \text{b2)}$$

At this point if $n_{head}$ has a positive value, the electronic processing unit 9 controls the switching on of a number N3'=$n_{head}$ of the luminous segments of the graphical attitude cross 18 (FIG. 7), while if $n_{head}$ has a negative value, the electronic processing unit 9 controls the switching on of a number N4'=$n_{head}$ of the luminous segments of the graphical attitude cross 18 (block 480) (FIG. 6).

In the case in which the relations a1) and b1) are satisfied the electronic processing unit 9 communicates to the operator the correct positioning of the grenade launcher 1 in the shooting attitude (block 500). In this case, in the example shown in FIG. 8, the electronic processing unit 9 controls the switching off of all segments and preferably, but not necessarily, the switching on of a central graphical icon including, for example, a circle centered on the center.

At this point the electronic processing unit 9 verifies if the computing interval Δt from the moment in which the operation has been carried out in block 210 (block 510) has passed and in a negative case (output no from block 510) remains in a waiting condition, while in a positive case (output yes from block 510) updates the actual moment $t_{act}$ by giving it the current moment, measured for example by way of an internal clock (block 520), and executes again the operation implemented in the block 200 and the subsequent operations.

From the above described it should be noted that the above-described operations shown in FIGS. 4*a*-4*d* can be encoded in a software program stored in the memory unit 10 and configured so that when it is loaded onto the electronic processing unit 9 the latter executes the same operations thereof so as to assist the operator in moving the grenade launcher.

The above-described assisting optoelectronic apparatus may be extremely advantageous because it automatically provides to the military operator a precise indication of the orientation to be given to the grenade launcher in such a way so as to successfully strike a moving target.

Finally, it is clear that changes and variations to the electronic apparatus and to the functioning method may be applied without extending beyond the scope of the present disclosure.

From the foregoing it will be appreciated that, although specific embodiments have been described herein for purposes of illustration, various modifications may be made without deviating from the spirit and scope of the disclosure. Furthermore, where an alternative is disclosed for a particular embodiment, this alternative may also apply to other embodiments even if not specifically stated.

The invention claimed is:

1. An optoelectronic digital apparatus for assisting an operator in determining the shooting attitude to be given to a hand-held grenade launcher so as to strike a moving target, through a grenade;

said apparatus comprising:

measuring electronic means configured so as to measure the pitch angle and the heading angle indicative of the attitude of the grenade launcher, and the distance of the target from the hand-held grenade launcher;

user interface means configured so as to receive an operator-assistance request at a first operative time, and communicate indications on the angles to cause the grenade launcher to strike a moving target; memory means containing ammunition-data indicative of the ballistic behavior of said grenade; environmental-data indicative of the environmental parameters; and precision-data indicative of the required impact precision;

processing electronic means configured to:

measure, through said measuring electronic means, a plurality of pitch angles and heading angles taken in a sequence from the grenade launcher in a predetermined data sampling range, during which the operator moves the grenade launcher to maintain it pointed towards the moving target;

measure, through said measuring electronic means, a plurality of distances taken in a sequence by the target from the grenade launcher during said data sampling range;

determine a displacement mathematical function associated with the motion of the target, on the basis of the pitch angles of the heading angles and of the distances measured during said data sampling range;

determine an ideal pitch angle and a theoretical impact time of the grenade on the target, through said displacement mathematical function and on the basis of the ammunition-data;

determine, on the basis of said ideal pitch angle, ammunition-data, environmental-data and precision-data, a shooting attitude comprising a shooting pitch angle and a shooting heading angle to be given to the grenade launcher so that the grenade strikes the target at said impact time;

measure, through said measuring electronic means, the actual pitch angle and the actual heading angle indicating the attitude given by the operator to the grenade launcher at said first operative time;

compute a pitch difference between the shooting pitch angle and the actual pitch angle measured at said first operative time;

compute a heading difference between the shooting heading pitch and the heading angle measured at said first operative time;

communicate, through said user interface, data indicative of the variation of the pitch angle and/or of the heading angle which the operator must give to the grenade launcher so that the pitch difference and the heading difference measured at said first operative time is zero;

said processing electronic means being also configured to:

determine an initial pitch angle through said displacement mathematical function on the basis of said ammunition-data and of said impact time;

compute a trajectory of said grenade on the basis of said initial pitch angle and of said ammunition-data and of said environmental-data;

vary said initial pitch angle until the corresponding trajectory of the grenade does not satisfy a convergence condition towards said target;

assign, to said shooting pitch angle, the pitch angle corresponding to the trajectory of the grenade that satisfies said convergence condition.

2. The apparatus according to claim 1, wherein said processing electronic means are configured so as to:

receive, through said interface means, a selection control of a flat-trajectory shot type or of a non-flat-trajectory shot type;

in case a flat-trajectory shot is selected, vary said initial pitch angle $\alpha i_{pitch}$ through the following relation:

$$\alpha_{ipitch} = \alpha_{ipitch} + \tan^{-1}\left(\frac{YT*(t_{imp}) - y_i}{Dist_{target}}\right)$$

in case a non-flat-trajectory shot is selected, vary said initial pitch angle through the following relation:

$$\alpha i_{pitch} = \alpha_{ipitch} - 0,3 \cdot \tan^{-1}\left(\frac{XT(t_{imp}) - x_i}{\max(y_i)}\right)$$

wherein $XT(t_{imp})$ and $YT(t_{imp})$ are the coordinates of the position of the target at the time of impact; xi and yi are the coordinates of the position taken by the grenade along the trajectory at a time i, determined with respect to a reference Cartesian system; and max(yi) is the maximum value of the coordinate of the trajectory of the grenade along a first axis of the reference Cartesian system.

3. The apparatus according to claim 2, wherein said processing electronic means are configured so as to compute said shooting heading angle $\alpha f_{head}$ through the following relation:

$$\alpha_{head}(I_{num}) = \alpha_{head}(t_{imp}) + \text{arctang}\left(GIT_X * 0.034 * \tan\left(\frac{\alpha f_{pitch} - \alpha i_{projectile}}{Dist_{target}(t_{imp})}\right)\right)$$

wherein $GIT_x$ is the projection of the throw of the grenade along the converging trajectory on a second axis of said reference Cartesian system.

4. The apparatus according to claim 3, wherein said processing electronic means are configured so as to:

compute a first infinitesimal displacement $x_i$, $y_i$ associated with the trajectory of said grenade along said first and second axis on the basis of said initial pitch angle $\alpha i_{pitch}$ and of said ballistic data and of said environmental-data, through the relations:

$$\Delta x_i = (x_i - x_{i-1}) = V_{in} \cdot \cos(\alpha_{i_{pitch}}) \cdot dt - \frac{1}{2}\left(\frac{C_d}{m} \cdot S \cdot \frac{p}{R \cdot T}\right) \cdot \cos(\alpha_{i_{pitch}}) \cdot V_{in}^2 \cdot dt^2$$

$$\Delta y_i = (y_i - y_{i-1}) = V_{in} \cdot \sin(\alpha_{i_{pitch}}) \cdot dt - \frac{1}{2}\left(\frac{C_d}{m} \cdot S \cdot \frac{p}{R \cdot T}\right) \cdot \sin(\alpha_{i_{pitch}}) \cdot V_{in}^2 \cdot dt^2 - g \cdot dt^2$$

wherein S is the front area of the grenade; m is the mass of the grenade; Cd is the aerodynamic drag coefficient of the grenade; Vin is the shooting speed of the grenade;

compute a first angle of inclination of the grenade through the relation:

$$\alpha_{i_{projectile}} = \tan^{-1}\left(\frac{\Delta y_i}{\Delta x_i}\right)$$

compute a shooting speed of the grenade through the relation:

$$V_{i_{projectile}} = \sqrt{\frac{\Delta x_i^2 + \Delta y_i^2}{dt^2}}$$

sequentially compute infinitesimal displacements $x_i$, $y_i$ associated with the trajectory of said grenade along said first and second axis on the basis of said initial pitch angle $\alpha i_{pitch}$ of said ballistic data and of said environmental-data, in which each computation implements said relations:

$$\Delta x_i = (x_i - x_{i-1}) = V_{i_{projectile}} \cdot \cos(\alpha_{i_{projectile}}) \cdot dt - \frac{1}{2}\left(\frac{C_d}{m} \cdot S \cdot \frac{p}{R \cdot T}\right) \cdot \cos(\alpha_{i_{projectile}}) \cdot V_{i_{projectile}}^2 \cdot dt^2 - \frac{1}{2}\left(\frac{C_l}{m} \cdot S \cdot \frac{p}{R \cdot T}\right) \cdot \cos(\alpha_{i_{projectile}}) \cdot \sin(\alpha_{i_{projectile}}) \cdot V_{i_{projectile}}^2 \cdot dt^2$$

-continued $$\Delta y_i = (y_i - y_{i-1}) = V_{i_{projectile}} \cdot \sin(\alpha_{i_{projectile}}) \cdot dt - \frac{1}{2}\left(\frac{C_d}{m} \cdot S \cdot \frac{p}{R \cdot T}\right) \cdot \sin(\alpha_{i_{projectile}}) \cdot V^2_{i_{projectile}} \cdot dt^2 + \frac{1}{2}\left(\frac{C_l}{m} \cdot S \cdot \frac{p}{R \cdot T}\right) \cdot \cos(\alpha_{i_{projectile}}) \cdot \cos(\alpha_{i_{projectile}}) \cdot V^2_{i_{projectile}} \cdot dt^2 - g \cdot dt^2.$$

5. The apparatus according to claim 4, wherein said processing electronic means are configured so as to determine the convergence condition of said trajectory towards the target when a first or a second condition is satisfied said first condition occurring if:

$X_i = \Delta X_i + X_{i-1} >= XT(t_{imp})$ and the selected shot type is a flat-trajectory shot;

said first condition occurring if:

$Y_i = \Delta Y_i + Y_{i-1} <= YT(t_{imp})$, the variation Δyi of the grenade is negative; and the selected shot type is a non-flat-trajectory shot.

6. The apparatus according to claim 5, wherein said processing electronic means are configured so as to vary said initial pitch angle $\alpha i_{pitch}$ when a third or a fourth condition are not satisfied; in which the third condition is satisfied if the position $X_i$ of the grenade is in the range defined by a minimum value $XT(t_{imp})-err_x$ and a maximum value corresponding to $XT(t_{imp})+err_x$ in which $err_x$ is a value of said precision-data that indicates the precision required along said second axis; while the fourth condition is satisfied if the value $Y_i$ of the grenade is in the range defined by a minimum value $YT(t_{imp})-err_y$ and a maximum value corresponding to $YT(t_{imp})+err_y$ in which $err_y$ is a value of said precision-data that indicates the precision required along said first axis.

7. The apparatus according to claim 6, wherein said interface means comprise a display displaying a graphical attitude cross provided with a plurality of luminous segments arranged aligned one after the other so as to form a first and a second attitude branch; said processing electronic means being configured to switch on/off:

the segments of a first attitude branch as a function of the variation of the pitch angle $\Delta\alpha_{pitch}$ to be given to the grenade launcher so as to orient it in the shooting attitude; and/or the segments of a second attitude branch orthogonal to the first attitude branch, as a function of the variation of the heading angle $\Delta\alpha_{head}$ to be given to the grenade launcher so as to orient it in the shooting attitude.

8. A method for assisting an operator through an optoelectronic digital apparatus in determining the shooting attitude of a hand-held grenade launcher so as to strike a moving target through the grenade, wherein said digital apparatus comprises measuring electronic means configured so as to measure the pitch angle and the heading angle indicative of the attitude of the grenade launcher, and the distance of the target from the hand-held grenade launcher; user interface means configured so as to receive an operator-assistance request at a first operative time, and communicate indications on the attitude to be given to the grenade launcher so as to strike the moving target; memory means containing ammunition-data indicative of the ballistic behaviour of said grenade; environmental-data indicative of the environmental parameters; and precision-data indicative of the required impact precision; said method comprising:

measuring, through said measuring electronic means, a plurality of pitch angles and heading angles taken in a sequence by the grenade launcher in a predetermined data sampling range, during which the operator moves the grenade launcher to maintain it pointed towards the moving target;

measuring, through said measuring electronic means a plurality of distances $Dist_{target}(t_{ci})$ taken in a sequence by the target from the grenade launcher during said data sampling range;

determining a displacement mathematical function associated with the motion of said target, on the basis of the pitch angles, of the heading angles and of the distances measured during said data sampling range;

determining an ideal pitch angle and a theoretical impact time of the grenade on the target, through said displacement mathematical function and on the basis of the ammunition-data;

determining, on the basis of said ideal pitch angle and of the ammunition-data, a shooting attitude comprising a shooting pitch angle and a shooting heading angle to be given to the grenade launcher so that the grenade strikes the target at said impact time;

measuring, through said measuring electronic means, the actual pitch angle and the actual heading angle indicating the attitude given by the operator to the grenade launcher at said first operative time;

computing a pitch difference between the shooting pitch angle and the actual pitch angle measured at said first operative time;

computing a heading difference between the shooting heading angle and the heading angle measured at said first operative time;

communicating, through said user interface, data indicative of the variation of the pitch angle and/or of the heading angle which the operator must give to the grenade launcher so that the pitch difference and the heading difference measured at said first operative time is zero, the method also comprising:

determining an initial pitch angle through said displacement mathematical function on the basis of said ammunition-data and of said impact time;

computing a trajectory of said grenade on the basis of said initial pitch angle and of said ammunition-data and of said environmental-data;

varying said initial pitch angle until the corresponding trajectory of the grenade does not satisfy a convergence condition towards said target;

assigning the pitch angle corresponding to the trajectory of the grenade that satisfies said convergence condition to said shooting pitch angle.

9. The method according to claim 8, comprising the steps of:

receiving, through said interface means, a selection control of a flat-trajectory shot type or of a non-flat-trajectory shot type;

in case a flat-trajectory shot is selected, varying said initial pitch angle $\alpha i_{pitch}$ through the following relation:

$$\alpha_{ipitch} = \alpha_{ipitch} + \tan^{-1}\left(\frac{YT(t_{imp}) - y_i}{Dist_{target}}\right)$$

in case a non-flat-trajectory shot is selected, varying said initial pitch angle $\alpha i_{pitch}$ through the following relation:

$$\alpha i_{pitch} = \alpha_{ipitch} - 0,3 \cdot \tan^{-1}\left(\frac{XT(t_{imp}) - x_i}{\max(y_i)}\right)$$

wherein $XT(t_{imp})$ and $YT(t_{imp})$ are the coordinates of the position of the target at the time of impact; xi and yi are the coordinates of the position taken by the grenade along the trajectory at a time i, determined with respect to a reference Cartesian system; and max(yi) is the maximum value of the coordinate of the trajectory of the grenade along a first axis of the reference Cartesian system.

10. The method according to claim 9, comprising the steps of computing said shooting heading angle $\alpha f_{head}$ through the following relation:

$$\alpha_{head}(I_{num}) = \alpha_{head}(t_{imp}) + \text{arctang}\left(GIT_X * 0.034 * \tan\left(\frac{\alpha f_{pitch} - \alpha i_{projectile}}{Dist_{target}(t_{imp})}\right)\right)$$

wherein $GIT_x$ is the projection of the throw of the grenade along the converging trajectory on a second axis (X) of said reference Cartesian system (S(X,Y,Z)).

11. The method according to claim 10, comprising the steps of:

computing a first infinitesimal displacement $x_i$, $y_i$ associated to the trajectory of said grenade along said first and second axis on the basis of said initial pitch angle $\alpha i_{pitch}$ and of said ballistic data and of said environmental-data, through the relations:

$$\Delta x_i = (x_i - x_{i-1}) = V_{in} \cdot \cos(\alpha_{i_{pitch}}) \cdot dt - \frac{1}{2}\left(\frac{C_d}{m} \cdot S \cdot \frac{p}{R \cdot T}\right) \cdot \cos(\alpha_{i_{pitch}}) \cdot V_{in}^2 \cdot dt^2$$

$$\Delta y_i = (y_i - y_{i-1}) = V_{in} \cdot \sin(\alpha_{i_{pitch}}) \cdot dt - \frac{1}{2}\left(\frac{C_d}{m} \cdot S \cdot \frac{p}{R \cdot T}\right) \cdot \sin(\alpha_{i_{pitch}}) \cdot V_{in}^2 \cdot dt^2 - g \cdot dt^2$$

wherein S is the front area of the grenade, m is the mass of the grenade; Cd is the aerodynamic drag coefficient of the grenade; Vin is the shooting speed of the grenade;

computing a first angle of inclination of the grenade through the relation:

$$\alpha_{i_{projectile}} = \tan^{-1}\left(\frac{\Delta y_i}{\Delta x_i}\right)$$

computing a shooting speed of the grenade through the relation:

$$V_{i_{projectile}} = \sqrt{\frac{\Delta x_i^2 + \Delta y_i^2}{dt^2}}$$

sequentially computing infinitesimal displacements $x_i$, $y_i$ associated with the trajectory of said grenade along said first and second axis on the basis of said initial pitch angle $\alpha i_{pitch}$, of said ballistic data and of said environmental-data, in which each computation implements said relations:

$$\Delta x_i = (x_i - x_{i-1}) = V_{i_{projectile}} \cdot \cos(\alpha_{i_{projectile}}) \cdot dt - \frac{1}{2}\left(\frac{C_d}{m} \cdot S \cdot \frac{p}{R \cdot T}\right) \cdot \cos(\alpha_{i_{projectile}}) \cdot V_{i_{projectile}}^2 \cdot dt^2 - \frac{1}{2}\left(\frac{C_l}{m} \cdot S \cdot \frac{p}{R \cdot T}\right) \cdot \cos(\alpha_{i_{projectile}}) \cdot \sin(\alpha_{i_{projectile}}) \cdot V_{i_{projectile}}^2 \cdot dt^2$$

$$\Delta y_i = (y_i - y_{i-1}) = V_{i_{projectile}} \cdot \sin(\alpha_{i_{projectile}}) \cdot dt - \frac{1}{2}\left(\frac{C_d}{m} \cdot S \cdot \frac{p}{R \cdot T}\right) \cdot \sin(\alpha_{i_{projectile}}) \cdot V_{i_{projectile}}^2 \cdot dt^2 + \frac{1}{2}\left(\frac{C_l}{m} \cdot S \cdot \frac{p}{R \cdot T}\right) \cdot \cos(\alpha_{i_{projectile}}) \cdot \cos(\alpha_{i_{projectile}}) \cdot V_{i_{projectile}}^2 \cdot dt^2 - g \cdot dt^2.$$

12. The method according to claim 8, comprising the steps of:

determining the convergence condition of said trajectory towards the target when a first or a second condition is satisfied said first condition occurring if:

$X_i = \Delta X_i + X_{i-1} >= XT(t_{imp})$ and the selected shot type is a flat-trajectory shot;

said second condition occurring if:

$Y_i = \Delta Y_i + Y_{i-1} <= YT(t_{imp})$, the variation Δyi of the grenade is negative; and the selected shot type is a non-flat-trajectory shot.

13. The method according to claim 8, comprising the steps of:

varying said initial pitch angle $\alpha i_{pitch}$ when a third or fourth condition are not satisfied; wherein the third condition is satisfied if the position $X_i$ of the grenade is comprised in the range defined by a minimum value $XT(t_{imp}) - err_x$ and a maximum value corresponding to $XT(t_{imp}) + err_x$ in which err is a value of said precision-data that indicates the precision required along said second axis; while the fourth condition is satisfied if the position $Y_i$ of the grenade is comprised in the range defined by a minimum value $YT(t_{imp}) - err_y$ and a maximum value corresponding to $YT(t_{imp}) + err_y$ in which $err_y$ is a value of said precision-data that indicates the precision required along said first axis.

14. The method according to claim 13, wherein said interface means comprise a display adapted to display a graphical attitude cross provided with a plurality of luminous segments arranged aligned one after the other so as to form a first and a second attitude branch;

said method comprising the steps of switching on/off:

the segments of a first attitude branch as a function of the variation of the pitch angle $\Delta\alpha_{pitch}$ to be given to the grenade launcher so as to orient it in the shooting attitude; and/or the segments of a second attitude branch orthogonal to the first attitude branch, as a function of the variation of the heading angle $\Delta\alpha_{head}$ to be given to the grenade launcher so as to orient it in the shooting attitude.

15. A computer product loadable on a memory of an electronic processing unit designed to implement, when run by the electronic processing unit, the method according to claim 8, so as to assist an operator in determining the shooting attitude to be given to a hand-held grenade launcher to strike a moving target.

* * * * *

UNITED STATES PATENT AND TRADEMARK OFFICE

CERTIFICATE OF CORRECTION

PATENT NO. : 8,757,487 B2
APPLICATION NO. : 13/810160
DATED : June 24, 2014
INVENTOR(S) : Nicola Santini, Andrea Magi and Enrico Fossati It is certified that error appears in the above-identified patent and that said Letters Patent is hereby corrected as shown below:

In the Claims

In Claim 2, Column 13, lines 48 to 52, formula should appear as follows:

$$\alpha_{ipitch} = \alpha_{ipitch} + \tan^{-1}\left(\frac{YT(t_{imp}) - y_i}{Dist_{target}}\right)$$

In Claim 2, Column 13, line 57, please insert the text --$\alpha i_{pitch}$-- before the text "through the following relation:"

In Claim 3, Column 14, lines 4 to 9, formula should appear as follows:

$$\alpha f_{head}(I_{num}) = \alpha_{head}(t_{imp}) + \arctan g(GIT_x * 0.034 * \tan(\frac{\alpha f_{pitch} - \alpha i_{projectile}}{Dist_{target}(t_{imp})})$$

In Claim 8, Column 16, line 7, the phrase "measuring, through said measuring electronic means a plurality of pitch angles" should read --measuring, through said measuring electronic means, a plurality of pitch angles--

In Claim 10, Column 17, line 20, formula should appear as follows:

$$\alpha f_{head}(I_{num}) = \alpha_{head}(t_{imp}) + \arctan g(GIT_x * 0.034 * \tan(\frac{\alpha f_{pitch} - \alpha i_{projectile}}{Dist_{target}(t_{imp})})$$

In Claim 13, Column 18, line 37, the phrase "$XT(t_{imp})+err_x$ in which err is a value" should read --$XT(t_{imp})+err_x$ in which $err_x$ is a value--

Signed and Sealed this
Seventh Day of April, 2015

Michelle K. Lee

Michelle K. Lee
*Director of the United States Patent and Trademark Office*